US012195151B2

(12) United States Patent
Huecking

(10) Patent No.: US 12,195,151 B2
(45) Date of Patent: Jan. 14, 2025

(54) UNDERWATER VEHICLE HAVING A HOLLOW CHARGE WITH VARIABLE ACTION

(71) Applicants: ATLAS ELEKTRONIK GMBH, Bremen (DE); thyssenkrupp AG, Essen (DE)

(72) Inventor: Christian Huecking, Achim (DE)

(73) Assignees: ATLAS ELEKTRONIK GMBH, Bremen (DE); thyssenkrupp AG, Essen (DE)

( * ) Notice: Subject to any disclaimer, the term of this patent is extended or adjusted under 35 U.S.C. 154(b) by 316 days.

(21) Appl. No.: 17/642,503

(22) PCT Filed: Sep. 4, 2020

(86) PCT No.: PCT/EP2020/074732

§ 371 (c)(1),
(2) Date: Mar. 11, 2022

(87) PCT Pub. No.: WO2021/048011

PCT Pub. Date: Mar. 18, 2021

(65) Prior Publication Data

US 2022/0340246 A1 Oct. 27, 2022

(30) Foreign Application Priority Data

Sep. 12, 2019 (DE) ..... 10 2019 213 945.0

(51) Int. Cl.

| | |
|---|---|
| ***B63G 8/00*** | (2006.01) |
| ***B63G 6/00*** | (2006.01) |
| ***B63G 7/02*** | (2006.01) |

(52) U.S. Cl.
CPC ..... *B63G 8/001* (2013.01); *B63G 6/00* (2013.01); *B63G 7/02* (2013.01)

(58) Field of Classification Search
CPC ..... F42B 12/10; F42B 12/105; F42B 12/12; F42B 19/00; B63G 8/001; B63G 6/00;
(Continued)

(56) References Cited

U.S. PATENT DOCUMENTS

2021/0156655 A1* 5/2021 Thornhill ..... F42C 13/00

FOREIGN PATENT DOCUMENTS

DE 27 45 744 A1 6/1978
DE 28 57 576 C1 7/1986
(Continued)

OTHER PUBLICATIONS

English Translation of International Search Report issued in PCT/EP2020/074732, dated Dec. 4, 2020.

*Primary Examiner* — Andrew Polay
(74) *Attorney, Agent, or Firm* — thyssenkrupp North America, LLC

(57) ABSTRACT

A watercraft may have a shaped charge and a gas reservoir. The gas reservoir may be adjacent to the shaped charge in a direction of action of the shaped charge. The gas reservoir can be varied in length in the direction of action of the shaped charge. Further, the shaped charge may be movable parallel to the direction of action of the shaped charge. A threaded rod can be used to move the shaped charge. In some cases a length of the gas reservoir is variable between 0.1-times and 10.0 times a diameter of the shaped charge. The watercraft may be configured in some instances as an unmanned underwater vehicle.

3 Claims, 1 Drawing Sheet

(58) Field of Classification Search
CPC ... B63G 7/02; B63G 3/06; B63G 3/02; B63G 3/04; B63G 2007/005
See application file for complete search history.

(56) References Cited

FOREIGN PATENT DOCUMENTS

| | | | |
|---|---|---|---|
| DE | 36 09 864 | B3 | 4/2004 |
| EP | 2 410 283 | A2 | 1/2012 |
| EP | 2 489 588 | A1 | 8/2012 |

* cited by examiner

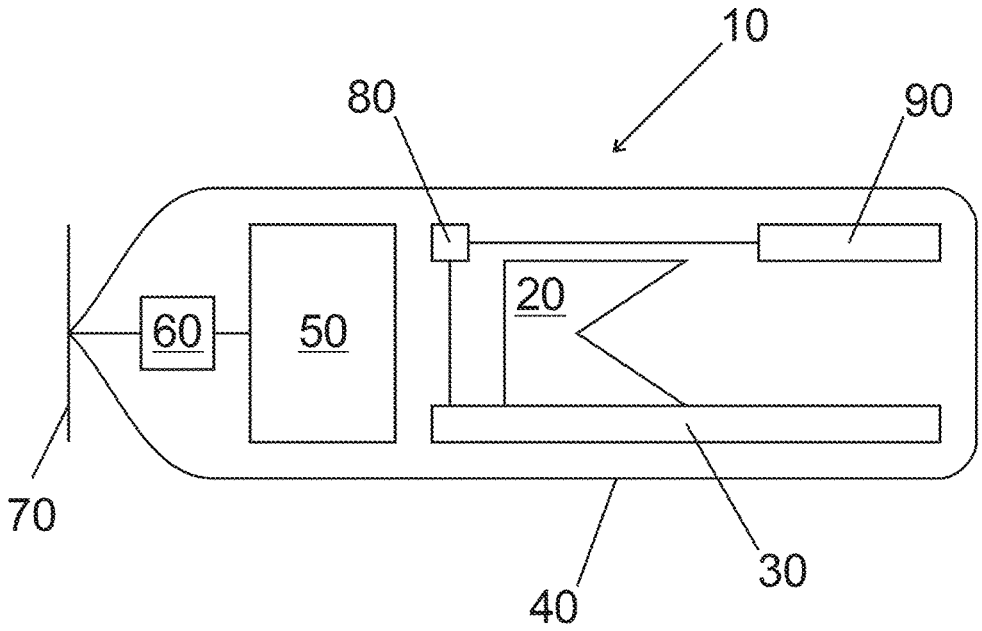
10
80
90
60
50
20
70
40
30

UNDERWATER VEHICLE HAVING A HOLLOW CHARGE WITH VARIABLE ACTION

CROSS REFERENCE TO RELATED APPLICATIONS

This application is a U.S. National Stage Entry of International Patent Application Serial Number PCT/EP2020/074732, filed Sep. 4, 2020, which claims priority to German Patent Application No. DE 10 2019 213 945.0, filed Sep. 12, 2019, the entire contents of both of which are incorporated herein by reference.

FIELD

The present disclosure generally relates to watercraft that have a shaped charge, including watercraft that are deployed in clearing objects such as mines.

BACKGROUND

Clearing a mine normally involves the explosive present within the mine being detonated from outside by a charge. A shaped charge is normally used for this purpose. However, the important thing in this case is that the explosive used in a mine may itself be hard to ignite and only the actual fuse contains highly explosive material. It is therefore necessary for a high energy input into the mine's explosive to be achieved in a volume. For this reason, a shaped charge is customarily used in order to detonate the explosive in a mine.

In a maritime environment, the arrangements in the three-dimensional space and also within the element region, and other bodies present within the environment, mean that it is not possible to approach the mine freely in every case. As a result of this, the distance between the mine and the watercraft used for mine clearance is deployment-dependent. This gives rise to the problem that an optimal introduction of energy into the explosive in the mine is not possible in every case, because water and other barrier layers such as the casing of the mine, for example, have an attenuating effect on the action of the shaped charge.

When clearing a mine it is essential to know whether the object that is to be exploded has been safely disarmed. The quickest and most reliable way of ensuring this is for the mine to be exploded during clearance. The parameters during clearance should therefore be such that the explosive which is present is detonated safely and reliably.

A shaped charge projectile for engaging underwater targets is known from DE 36 09 864 B3, wherein a telescopic arrangement is arranged in front of the shaped charge.

A shaped explosive charge device for underwater use, having a spacing area with an inflatable element is known from DE 27 45 744 A1.

Thus, a need exists for a watercraft in which an optimal application of energy into the explosive can be achieved irrespective of the distance that can be achieved between the watercraft and a mine.

BRIEF DESCRIPTION OF THE FIGURES

FIG. 1 is a schematic cross-sectional view of an example watercraft.

DETAILED DESCRIPTION

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The watercraft according to the invention comprises a shaped charge. In the direction of action of the shaped charge, a gas reservoir is then adjacent to the shaped charge. The gas reservoir is important, as a plasma beam is formed in this gas reservoir when the shaped charge is detonated, and the shape of the plasma beam, as well as the speed thereof, are influenced by the length of the gas reservoir in the direction of action.

The gas reservoir described herein is variable in length in the direction of action of the shaped charge.

By varying the length of the gas reservoir, the shape and speed of the plasma beam can be selectively adapted to the current requirements. The longer the gas reservoir, the narrower and quicker the plasma beam. With a shorter gas reservoir, a wider plasma beam with a slower speed is produced.

Since the energy application to the explosive is proportional to the speed of the beam and the cross-sectional surface of the beam at the site of the explosive, by varying the plasma beam, the energy loss between the watercraft and the mine can be optimized. For this purpose, when there is a small distance between the watercraft and the mine, the length of the gas reservoir is maximized and a comparatively rapid plasma beam is thereby produced. Although this rapid plasma beam suffers greater attenuation in the water, since the distance is small, the energy losses with a short distance are smaller by comparison with a wide, slow plasma beam. If the distance between the watercraft and mine is longer, however, the gas reservoir is shortened and a comparatively slow plasma beam is thereby produced. This is slower and is therefore less attenuated by the surrounding water. Consequently, there is a greater application of energy in the mine at a long distance.

According to the invention, the shaped charge is arranged so as to be movable parallel to the direction of action of said shaped charge. Particularly preferably, the direction of action of the shaped charge is parallel to the longitudinal direction of the watercraft. By moving the shaped charge, a particularly simple modification of the gas reservoir is possible. In particular, the outer casing of the watercraft represents the natural boundary of the gas reservoir and thereby limits the gas reservoir in a fixed manner at one end.

In a further alternative embodiment of the invention, the shaped charge is fixed and a boundary wall is arranged so as to be movable between the shaped charge and the outer casing of the watercraft, such that the length of the gas reservoir between the shaped charge and the boundary wall can be adjusted by the movement of said boundary wall. This embodiment is preferred, insofar as the boundary wall has at least one further degree of freedom, for example it can be tilted in one or two axes. A further configuration option for the plasma beam can thereby be facilitated.

In a further embodiment of the invention, the shaped charge can be moved by means of a threaded rod. The advantage of this embodiment is its comparatively robust design.

In a further embodiment of the invention, the length of the gas reservoir can be varied to between 0.1 times and ten times the diameter of the shaped charge. Particularly preferably, the length of the gas reservoir can be varied to between 0.5 times and seven times the diameter of the shaped charge. A further extension of the gas reservoir does not lead to a further acceleration, which means that larger sizes do not yield any benefits. Since a mine always has a wall, a minimum length is also advisable, since the actual distance between the shaped charge and the explosive limits can therefore never be zero.

In a further embodiment of the invention, the watercraft has a distance detection device, wherein the distance detection device is able to detect the distance between the watercraft and an object arranged in front of said watercraft, in particular a mine. The watercraft has a movement device for changing the length of the gas reservoir. In addition, the watercraft has a control device, wherein the control device is designed to determine the optimum length of the gas reservoir from the distance detected between the watercraft and the object arranged in front of the watercraft, and to control the direction of movement for adjustment of the length of the gas reservoir. For example and in particular, the distance detection device comprises a sonar device or an optical sensor, such as a camera or a laser-based distance meter. In particular, the control device is designed to shorten the length of the gas reservoir, the greater the distance between the watercraft and the object.

In a further embodiment of the invention, the watercraft is an unmanned underwater vehicle. Particularly preferably, the watercraft is a remote-controlled unmanned underwater vehicle. Remote control makes it possible for the shaped charge to be released by an operator from a safe location, on the basis of recognized protocols, safely and reliably. Alternatively, the watercraft may also be an autonomous, unmanned underwater vehicle, which, however, is not without problems on account of the autonomous detonation of an explosive charge.

FIG. 1 Cross Section

FIG. 1 shows by way of example a watercraft according to the invention. A shaped charge 20 can be moved by means of a threaded rod 30. In this way, the distance between the shaped charge 20 and the casing 40 is varied, where a gas reservoir is located. The watercraft 10 can be moved by means of a propeller 70. The watercraft preferably has a battery 50 and a motor 60 for this purpose. The distance from an object can be determined using sonar 90 as the distance detection device, and the optimal position of the shaped charge 20 can thereby be determined and controlled by means of a control device 80.

REFERENCE SIGNS

10 watercraft
20 shaped charge
30 threaded rod
40 casing
50 battery
60 motor
70 propeller
80 control device
90 sonar

What is claimed is:

1. A watercraft comprising:

a shaped charge;

a gas reservoir adjacent to the shaped charge in a direction of action of the shaped charge, wherein the gas reservoir is variable in length in the direction of action of the shaped charge, wherein the shaped charge is movable parallel to the direction of action of the shaped charge;

a distance detection device configured to detect a distance between the watercraft and an object arranged in front of the watercraft;

a movement device for changing the length of the gas reservoir;

a control device configured to determine an optimum length of the gas reservoir based on the distance that is detected between the watercraft and the object in front of the watercraft and control a direction of movement for adjustment of the length of the gas reservoir based on the determined optimum length;

wherein the shaped charge is movable by way of a threaded rod.

2. The watercraft of claim 1 wherein a length of the gas reservoir is variable between 0.1-times and 10.0 times a diameter of the shaped charge.

3. The watercraft of claim 1 configured as an unmanned underwater vehicle.

* * * * *